United States Patent [19]

Jürgens

[11] Patent Number: 4,969,528

[45] Date of Patent: Nov. 13, 1990

[54] METHOD AND APPARATUS FOR CONTINUOUS PILOT HOLE CORING

[75] Inventor: Rainer Jürgens, Celle, Fed. Rep. of Germany

[73] Assignee: Baker Hughes Incorporated, Houston, Tex.

[21] Appl. No.: 381,489

[22] Filed: Jul. 18, 1989

[30] Foreign Application Priority Data

Jul. 25, 1988 [DE] Fed. Rep. of Germany ..... 3825225

[51] Int. Cl.[5] ..... E21B 10/02; E21B 10/62; E21B 10/64

[52] U.S. Cl. ..... 175/58; 175/101; 175/107

[58] Field of Search ..... 175/107, 101, 246, 244, 175/94, 58, 20

[56] References Cited

U.S. PATENT DOCUMENTS

| | | | |
|---|---|---|---|
| 2,898,086 | 8/1959 | Freeman et al. | 175/58 |
| 2,910,273 | 10/1959 | Bon | 175/107 |
| 2,915,285 | 12/1959 | Deily | 175/17 |
| 2,944,792 | 7/1960 | Gros | 175/107 |
| 3,903,975 | 9/1975 | Sweeney | 175/246 |
| 3,990,524 | 11/1976 | Sweeney | 175/246 |
| 4,452,322 | 6/1984 | Jurgens | 175/107 |
| 4,518,050 | 5/1985 | Sollie et al. | 175/250 |
| 4,773,489 | 9/1988 | Makohl | 175/107 |
| 4,875,531 | 10/1989 | Biehl et al. | 175/250 |

*Primary Examiner*—Stephen J. Novosad
*Attorney, Agent, or Firm*—Joseph A. Walkowski; Michael Polacek

[57] ABSTRACT

The present invention comprises an improved method and apparatus for taking core samples, wherein a core drilling assembly driven by a downhole fluid motor is retrievably housed within a drilling tool of larger diameter, and wherein a plurality of cores may be cut and retrieved to the surface by withdrawal of the core drilling assembly by including an extender in the core drilling assembly each time it is brought to the surface and returned to the drilling tool, and sequentially cutting another core without postdrilling the previously cored formation section. The extenders may be included either above or below the motor used to drive the core drilling assembly, and are preferably of tubular configuration with screw-threaded connectors at their ends for rapid insertion in and removal from the core drilling assembly.

12 Claims, 2 Drawing Sheets

METHOD AND APPARATUS FOR CONTINUOUS PILOT HOLE CORING

BACKGROUND AND SUMMARY OF THE INVENTION

The goal of the invention is simplification and acceleration of the drill-out of rock cores and of reducing the costs for extraction of rock core samples.

The invention makes it possible to obtain rock core samples form a significant formation depth, without having to postdrill the primary drill hole after each drill-out of a rock core. A core hole with its usually much smaller diameter can be drilled beyond the bottom of the primary drilled hole to a length of, for example, one hundred or more meters, without any intermediate postdrilling. In cases where the drilling is stopped due to information obtained from the rock samples, postdrilling is unnecessary, so that considerable cost savings will results. At the same time, the drilling time is reduced, even when postdrilling is needed when continuing the drilling project, because postdrilling along a distance corresponding to a multiple of one core length is faster to complete than a number of separate postdrilling processes along drill routes of single core lengths. The type of core drill hole resulting from the present invention has a continuous profile, because the core drill holes are cut under constant conditions due to the unchanged position of the outer tube of the drilling tool bracing the coring device. The outer tube of the drilling tool forms a type of underground replacement for a stopped turntable.

The insertion into the coring unit of an extender when the coring unit is pulled out of the hole after each core extraction is exceptionally simple and quick, and upon removal of the sequentially inserted extenders after completion of one core drilling operation and before postdrilling of the primary hole, groups of extenders can be removed and unscrewed from each other, regardless of the coring unit being used. The extraction of rock core samples according to the invention makes it possible, when postdrilling the primary hole, to use not only the usual roller cone type core bit, but also to use a fixed-cutter type drag bit as a part of the drilling tool. The latter type of bit combines greater drilling performance with far greater strength and is able to avoid every second round trip needed for postdrilling when using core bits.

BRIEF DESCRIPTION OF THE DRAWINGS

Other details and advantages arise from the following description and the figures, which show two exemplary designs of the invention in more detail. The figures show.

DESCRIPTION OF THE PREFERRED EMBODIMENTS

Figure 1:
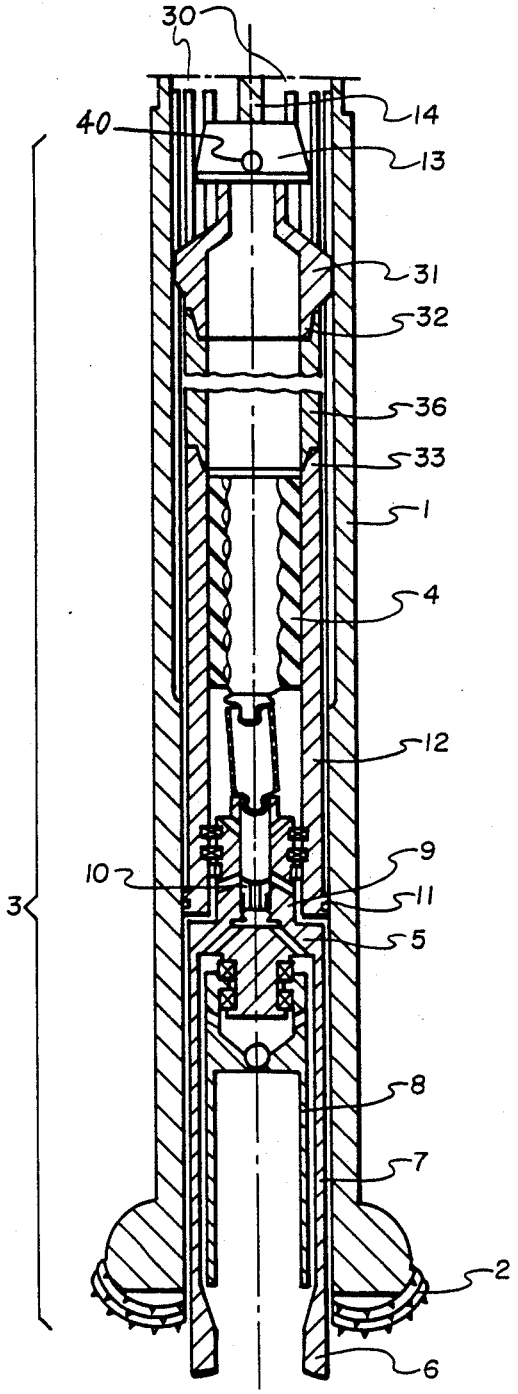
FIG. 1: A longitudinal schematic section through a first design of the invented core drilling tool at the beginning of a core drilling operation.

The drilling tool illustrated in FIG. 1 has outer tube 1 which is connectable at its upper end to a drill string (not illustrated). At the lower end there is roller cone type core bit 2 used for drilling an annulus or the primary drill hole for lowering of outer tube 1. Within outer tube 1 there is coring unit 3 consisting of motor 4 and core drilling assembly 5. This coring unit 3 can shift axially within outer tube 1. While motor 4 is prevented from turning, core drilling assembly 5 is rotationally mounted. Core drilling assembly 5 itself consists of core tube 7 supporting a core bit 6 and surrounding rotationally mounted inner tube 8 within it. Between motor 4 and core drilling assembly 5, there is bypass 9 which divides the drilling fluid exiting from motor 4 into a first stream flowing between outer tube 1 and core tube 7, and into another stream between core tube 7 and inner tube 8. The stream flowing between outer tube 1 and core tube 7 is controlled by spring loaded valve 10 so that it remains constant in spite of decreasing throttling of the flow path due to increasing exposure of core drilling assembly 5 as coring progresses.

In order to prevent an undesired bypassing of motor 4 by the drilling fluid, motor 4 is provided with collar 11 which fills the annulus between its housing and outer tube 1. Collar 11 is sealed against outer tube 1 and, with other housing elements of motor 4, it forms subsurfaces which fill the cross-sectional surface of inner passage region 12 of outer tube 1. These subsurfaces provide a reaction surface to the drilling fluid pressure applied to coring unit 3 and generates the axial propulsion force for coring unit 3.

In the upper region of motor 4 there is cable head 13 which permits the extraction of entire coring unit 3 after drilling out a core. Cable head 13 is used as a means for adjusting the axial propulsion force, by providing a retention force on core drilling assembly 5 through cable 14, which extends to coring unit 3 through the drill string from a winch located on the drilling ring. Depending on the level of the retaining force, values between zero and a maximum value can be set for the resulting axial propulsion force. The maximum value of the axial propulsion force is reached via the drilling fluid pressure applied to coring unit 3 through the reaction surfaces. The cable head 13 includes one or more drilling fluid ports 40 which allow the drilling fluid to reach and power the motor 4.

The upper portion of outer tube 1 is provided with internal longitudinal groove region 30. Near its upper end, coring unit 3 has key collar 31 making a nonrotating joint when mated with longitudinal groove region 30 of outer tube 1.

Beneath this key collar 31 there is a separation point with mating connectors 32, 33 or 34, 35 which are designed as screw threads according to the preferred embodiment. At these separation points, the parts of the coring unit can be connected via their connectors 32, 33 or 34, 35 either directly, or through extenders 36 or 37 which are preferably shaped as tubular elements and provided at their ends with appropriate connectors.

Figure 2:
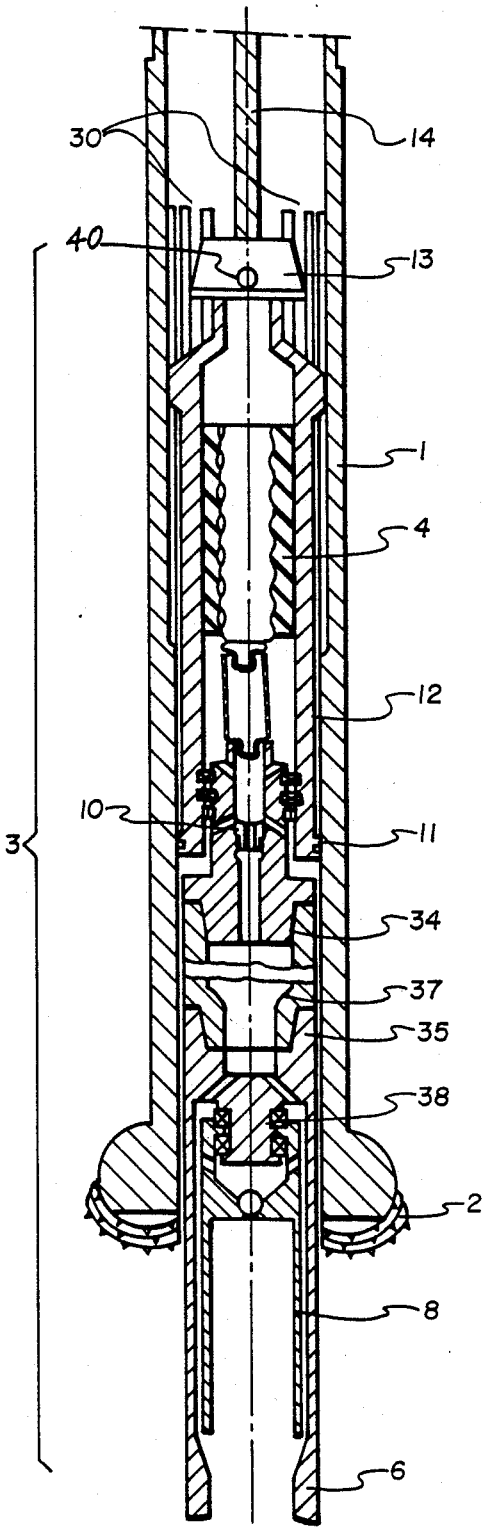
FIG. 2: A schematic similar to FIG. 1 of a second design of the core drilling tool of the invention at the end of a core drilling operation.

In the design of FIG. 1, a separation point is located between cable head 13 and the upper end of motor 4, but it is also possible to place the separation point on top of core drilling tube 7 between motor 4 and bearing section 38 for inner tube 8, as shown in FIG. 2. The length of extender pieces 36 or 37 should generally correspond to the length of the core holder chamber of inner tube 8.

During a core drilling operation, a number of extenders 36 or 37 can be inserted between connectors 32, 33 or 34, 35 so that during one core drilling operation, a corresponding number of rock cores can be drilled in direct sequence and retrieved to the surface before postdrilling of the primary hole becomes necessary. The number of intermediate extenders 36, 37 and thus the length of the advancing core drilling hole depends essentially on material strengths, type of rock formations and perhaps on the length that a primary hole can be postdrilled using cone-type core bit 2 or a fixed cutter drag bit, until due to wear on the cone-type core bit or on the fixed cutter drag-type core bit, a round trip for the entire drilling tool becomes necessary.

I claim:

1. A drilling tool comprising an outer tube connectable to a drill string and a coring unit axially movable but rotationally fixed in said outer tube, said coring unit including means for producing an axial propulsion force acting on the coring unit in a downward direction and means for adjusting said axial propulsion force, and said coring unit further comprising a core drilling assembly including a rotary-driven core tube bearing a core bit and a freely rotating inner tube braced within said core tube and a drilling fluid operated motor coupled to the core drilling assembly, wherein the coring unit, below the region of its rotationally fixed engagement with the outer tube, has a separation point with mating connectors and at least one extender insertable thereat in the coring unit.

2. The drilling tool of claim 1 wherein the axial propulsion force producing means include a reaction surface on said coring unit that can be pressurized by drilling fluid pressure to produce said axial propulsion force.

3. The drilling tool of claim 1 wherein said adjusting means include a cable head for restraining said coring unit.

4. The drilling tool of claim 1 wherein the separation point is located between the restraining means and the motor.

5. The drilling tool of claim 1 wherein the separation point is located at the upper region of the core tube between the core tube's connection to the motor and a bearing device for the inner tube.

6. The drilling tool of claim 1, 4, or 5 wherein the connectors comprise screw threads which are connectable either directly to each other or to corresponding screw threads at the ends of the extenders.

7. The drilling tool of claim 1, 4, or 5 wherein the extenders have a length corresponding essentially to the length of the core holder cavity of the inner tube and have an outer diameter corresponding to the outer diameter of the coring unit in the region of the separation points.

8. A method for obtaining a desired plurality of rock samples from a primary subterranean drill hole produced with a drilling tool comprising the steps of:

drilling a cylindrical rock core sample out by a core drilling assembly of lesser diameter than the drilling tool, wherein said core drilling assembly is driven directly and separately from the drilling tool and pushed axially therefrom;

lifting the core drilling assembly to the surface;

retrieving the drilled rock sample from within said lifted core drilling assembly;

extending the core drilling assembly by inserting an extension piece therein;

lowering the extended core drilling assembly into the drilling tool; and repeating the above steps until the desired plurality of rock core samples is extracted.

9. The method of claim 8 wherein the primary drilled hole is postdrilled after the desired plurality of rock core samples is extracted.

10. The method of claim 9 wherein the postdrilling of the primary hole is performed after one sequential extraction of 15 to 30 rock cores.

11. The method of claim 9 or 10 wherein the postdrilling of the primary hole uses a core bit.

12. The method of claim 9 or 10 wherein the postdrilling of other primary hole uses a rotary drill bit.

* * * * *